US009631264B2

(12) United States Patent
Takahashi et al.

(10) Patent No.: US 9,631,264 B2
(45) Date of Patent: Apr. 25, 2017

(54) SOFT MAGNETIC POWDER CORE

(71) Applicant: TDK CORPORATION, Tokyo (JP)

(72) Inventors: Takeshi Takahashi, Tokyo (JP); Tomoshi Nakamoto, Tokyo (JP); Kenichi Nishikawa, Tokyo (JP)

(73) Assignee: TDK Corporation, Tokyo (JP)

( * ) Notice: Subject to any disclaimer, the term of this patent is extended or adjusted under 35 U.S.C. 154(b) by 11 days.

(21) Appl. No.: 14/577,665

(22) Filed: Dec. 19, 2014

(65) Prior Publication Data

US 2015/0187476 A1 Jul. 2, 2015

(30) Foreign Application Priority Data

Dec. 26, 2013 (JP) ..... 2013-269001
Oct. 8, 2014 (JP) ..... 2014-207109

(51) Int. Cl.

| | |
|---|---|
| ***C22C 38/12*** | (2006.01) |
| ***H01F 1/147*** | (2006.01) |
| ***C22C 38/00*** | (2006.01) |
| ***H01F 1/33*** | (2006.01) |
| ***C22C 45/00*** | (2006.01) |
| ***B22F 1/02*** | (2006.01) |
| ***C22C 33/02*** | (2006.01) |

(52) U.S. Cl.

CPC ..... *C22C 38/12* (2013.01); *B22F 1/02* (2013.01); *C22C 33/0264* (2013.01); *C22C 38/00* (2013.01); *C22C 45/00* (2013.01); *H01F 1/33* (2013.01)

(58) Field of Classification Search

None

See application file for complete search history.

(56) References Cited

U.S. PATENT DOCUMENTS

2009/0174512 A1* 7/2009 Watanabe ..... B22F 1/02 335/296

FOREIGN PATENT DOCUMENTS

| | | | |
|---|---|---|---|
| JP | A-2006-241583 | | 9/2006 |
| JP | 2008091413 A | * | 4/2008 |
| JP | A-2008-88459 | | 4/2008 |
| JP | A-2011-181624 | | 9/2011 |

OTHER PUBLICATIONS

Machine translation of JP2008-091413A, Apr. 2008.*

* cited by examiner

*Primary Examiner* — Jie Yang
*Assistant Examiner* — Xiaowei Su
(74) *Attorney, Agent, or Firm* — Oliff PLC

(57) ABSTRACT

The present invention provides a soft magnetic powder core with a high electrical resistivity and a high strength. The soft magnetic powder core of the present invention is characterized in that in the soft magnetic powder core containing soft magnetic metal particles with Fe as the main component, the powder core has the structure in which oxide portions are present among soft magnetic metal particles, and the oxide portions are composed of oxides containing V, B and Fe. Further, the amount of B contained in the oxide portions of the powder core is 0.5 or more times and 5.0 or less times of the amount of V in terms of mass ratio.

10 Claims, 3 Drawing Sheets

SOFT MAGNETIC POWDER CORE

The present invention relates to a soft magnetic powder core with a high electrical resistivity and a high strength which is used in various electromagnetic components such as a motor, an actuator, a generator, a reactor, a choke coil and the like.

BACKGROUND

Up to now, the powder magnetic core using soft magnetic metal particles is being developed as the magnetic core for the motor, the actuator, the generator, the reactor, the choke coil and the like. Generally speaking, it is known that the magnetic core prepared by compressing the powder has a low mechanical strength. A high mechanical strength is required in the magnetic core so that the damage of the product can be prevented in use. Further, as the electromagnetic component is downsized, its working frequency tends to be high. If the working frequency becomes higher, the eddy current loss inside the magnetic core will sharply rise. Thus, a powder magnetic core with a high electrical resistivity is required to prevent the occurrence of such a loss.

In a preparation method which is used to improve the mechanical strength of the powder core, it is proposed to increase the molding pressure or the temperature during the thermal treatment. However, although the powder core prepared by such treatments has an increased mechanical strength, the insulating coating film formed on the surface of the soft magnetic metal particles is likely to peel off or decompose during the molding process or the thermal treatment, and thus the electrical resistivity becomes low. If the electrical resistivity decreases, the core loss increases as the eddy current inside the magnetic core rises, leading to the decrease of the output or the efficiency of the product.

Thickening the insulating coating film covering the soft magnetic metal particles is known to be effective in order to prepare a power magnetic core with a high electrical resistivity. However, if the insulating coating film is thickened, the strength will become lower as the stress is likely to concentrate on the interior of the coating film. Therefore, there is no soft magnetic powder core with both a high electrical resistivity and a high strength.

In order to solve the technical problem, for example. Patent Document 1 has disclosed a preparation method in which the solution formed by dissolving a complex of elements which constitute the vanadium oxide based glass with a low melting point or dissolving an alkoxide in an organic solvent is coated on the surface of iron powders and then the coating film is dried and subjected to a thermal treatment to form a vanadium oxide based glass coating film with a low melting point. In addition, Patent Document 2 has disclosed a preparation method in which an oxide coating film containing Mg is formed on soft magnetic metal powders to obtain a soft magnetic composite material with a high mechanical strength. Also, Patent Document 3 has disclosed a soft magnetic composite material with a high mechanical strength and a high specific resistance and a method for preparing the same, wherein the soft magnetic composite material is obtained by mixing insulating coated soft magnetic particles and glass powders with a low melting point and then firing the mixture.

PATENT DOCUMENTS

Patent Document 1: JP-A-2008-88459
Patent Document 2: JP-A-2006-241583
Patent Document 3: JP-A-2011-181624

SUMMARY

However, although the technique in Patent Document 1 could increase the bending strength and decrease the core loss, the value of the strength is 180 MPa or lower, which is not sufficient to prevent the damage of the magnetic core. Further, as a high temperature is needed for the thermal treatment, the value of the electrical resistivity is lower than 2000μΩ·m. In this respect, a high strength and a high electrical resistivity cannot be obtained at the same time.

In the technique of Patent Document 2, a material obtained by forming an oxide coating film containing Mg on the soft magnetic metal powders is used to prepare the soft magnetic composite material. Thus, a high mechanical strength of 190 MPa or more is obtained but the value of the electrical resistivity is lower than 2000μΩ·m so that the high strength and the high electrical resistivity can not be obtained at the same time.

In the technique of Patent Document 3, a material obtained by forming an oxide coating film containing Mg on the soft magnetic metal powders is used to prepare the soft magnetic composite material, and this composite material is further mixed with the glass with a low melting point to form a glass layer with a low melting point. In this way, a powder core is obtained with the electrical resistivity and the mechanical strength higher than that of the conventional powder cores. However, the obtained mechanical strength has a value of 190 MPa or more while the value of the electrical resistivity is lower than 2000μΩ·m which is not high enough.

The present invention is completed in view of the situation mentioned above and aims to provide a soft magnetic powder core so that a powder core with both a high electrical resistivity and a high strength can be easily realized.

In order to solve the technical problem mentioned above and achieve the goal, the soft magnetic powder core according to the present invention is characterized in that in the soft magnetic powder core which contains soft magnetic metal particles with Fe as the main component, oxide portions containing V, B and Fe are present among the soft magnetic metal particles, and the amount of B is 0.5 or more times and 5.0 or less times of the amount of V in terms of mass ratio. In such a way, a soft magnetic powder core can be obtained with a high electrical resistivity and a high strength.

If the electromagnetic properties and the mechanical properties of the soft magnetic powder core with such a structure are measured, it can be confirmed that this soft magnetic powder core has a high electrical resistivity and a high strength compared to the conventional products. The mechanism of action for producing such an effect is not clear now and can be presumed as follows.

In the soft magnetic powder core which contains soft magnetic metal particles with Fe as the main component, the soft magnetic metal particles are insulated with each other by the oxide portions containing V, B and Fe, and the amount of B is 0.5 or more times and 5.0 or less times of the amount of V in terms of mass ratio. Thus, the electrical resistivity of the soft magnetic powder core is significantly higher then that of a powder core without oxide portions. Further, as the oxide portions contain V, B and Fe and the amount of B is 0.5 or more times and 5.0 or less times of the amount of V in terms of mass ratio, the soft magnetic powder core with a higher strength can be realized.

In a preferable embodiment of the present invention, the oxide portions further contain P and at least one selected from the group consisting of Na, Zn, Ba, Si and Zr. If the oxide portions contain P and at least one selected from group consisting of elements mentioned above, insulativity of the oxide portions can be further improved. Also, as the oxide portions contain P and at least one selected from group consisting of elements mentioned above, the adhesion to the soft magnetic metal particles becomes better and the mechanical strength becomes higher.

The total amount of V and B contained in the oxide portions inside the powder core is 0.1 mass % or more and 1.0 mass % or less. When the amount of V and B falls within the range mentioned above, the composition and the film thickness of the oxide portions are appropriate so that a soft magnetic powder core with a high electrical resistivity and a high mechanical strength can be prepared.

The oxide portions have a multilayered structure with three layers or more in the interior. When a multilayered structure with three layers or more is formed in the oxide portion, the electrical resistivity can be further increased because resistance among layers is added.

The powder magnetic core preferably further contains glass portions in the interior. The glass portions fill the voids among the soft magnetic metal particles and function as the bonding portions in the particle interfaces, and thus the mechanical strength of the soft magnetic powder core will be further improved.

The present invention is capable of providing a soft magnetic powder core with a high electrical resistivity and a high strength.

DETAILED DESCRIPTION OF EMBODIMENTS

Figure 1:
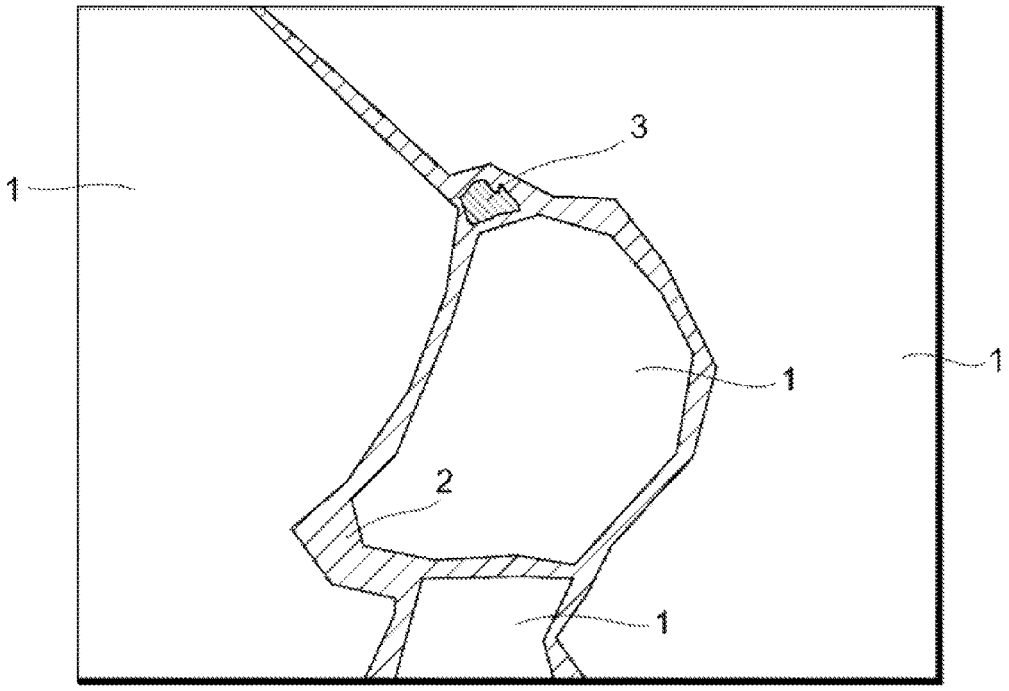
FIG. 1 is a partial cross-section view schematically showing the soft magnetic powder core in the present embodiment.

Hereinafter, the embodiments of the present invention will be described. In addition, the positional relationship is based on those shown in the drawings as long as it is not particularly limited. Also, the dimension proportion is not limited to those shown in the drawings. Further, the following embodiments are exemplary to describe the present invention, and the present invention is not limited to these embodiments.

The soft magnetic powder core of the present embodiment is characterized in that it is provided with a structure having soft magnetic metal particles 1 (with Fe as the main component) and oxide portions 2 positioned among the soft magnetic metal particles, wherein, the oxide portions 2 contain V, B and Fe, and the mass ratio of the amount of B to the amount of V, both of which are contained in the oxide portions inside the soft magnetic powder core, is 0.5 or more and 5.0 or less.

FIG. 1 is a schematic cross-section view showing one embodiment of the soft magnetic powder core in the present embodiment. The soft magnetic powder core has the soft magnetic metal particles 1 and the oxide portions 2 positioned among the soft magnetic metal particles, and it may contain scattered glass portions 3 depending on the situation.

In the soft magnetic metal particles 1, the powders (particles) (with Fe as the main component) of Fe and Fe based alloy are used as the starting powder. The Fe based alloy can be, for example, Fe—Si based alloy. Fe—Al based alloy, Fe—N based alloy, Fe—C based alloy, Fe—B based alloy, Fe—Co based alloy Fe—P based alloy, Fe—Ni—Co based alloy, Fe—Cr based alloy, Fe—Al—Si based alloy and the like. Among these alloys, one kind can be used alone, or two or more kinds can be used in combination.

In the soft magnetic metal particles 1, the starting powder can be one containing 50 mass % or more of Fe. More preferably, 90 mass % or more of Fe is contained. As the staring powder with a high amount of Fe will have a lower Vickers hardness of the particles than that of the Fe based alloys mentioned above, it tends to have an excellent moldability. In this respect, the use of such a starting powder can be used to try for the densification of the soft magnetic powder core and the improvement of the mechanical strength. In addition, as the oxide portions 2 contain V, B and Fe, the connectivity to the soft magnetic metal particles 1 with Fe as the main component becomes better. Thus, the adhesion will be further improved, so the soft magnetic powder core with a high strength can be realized.

The oxide portions 2 are constituted by a mixture of the oxides of V, B and Fe and the composite oxides thereof. With respect to the oxides and the composite oxides, it is preferable that the compound of V and the compound of B are reacted via heat under pressure, the Fe in the soft magnetic metal particles 1 which is from the starting powder is diffused thereamong, and thus the oxides and the composite oxides are formed among the soft magnetic metal particles. Accordingly, the thus formed borate glass or composite oxide of vanadium will easily obtain a crystal structure which is a three dimensional network one. Further, the adhesion to the soft magnetic metal particles 1 and the mechanical strength will be improved by further containing Fe in the oxide portions 2.

In addition, in the oxide portions 2 inside the soft magnetic powder core, the mass ratio of the amount of B to the amount of V is 0.5 or more and 5.0 or less. The amount of B and the amount of V contained in the oxide portions 2 inside the powder magnetic core is preferably obtained by subtracting the amount of B and the amount of V contained in the whole starting powder measured by a ICP-AES measurement apparatus from the amount of B and the amount of V contained in the whole powder magnetic core measured by the same method. The method for measuring the amount of B and the amount of V contained in the oxide portions 2 inside the soft magnetic powder core is not limited thereto if a method with a better accuracy is present. When the amount of V and the amount of B contained in the oxide portions 2 of the powder magnetic core fall within the range of the mass ratio mentioned above, the oxides and composite oxides of the V compound and the B compound are produced and the strength of the oxide portions becomes higher, and thus the mechanical strength of the powder magnetic core also becomes higher. Besides, a high electrical resistivity can be obtained by containing more B compounds.

With respect to the V compound, oxide, oxalate, fluoride, vanadate and alkoxide are preferable. Specifically, the V compound can be vanadium oxide, vanadyl oxalate, vanadium fluoride, sodium vanadate, ammonium vanadate, vanadium oxymethoxide, vanadium oxyethoxide, vanadium oxyisopropoxide, vanadium oxypropoxide, vanadium oxyisobutoxide, vanadium oxybutoxide. Among these compounds, one kind can be used alone, or two or more kinds can be used in combination.

With respect to the B compound, oxide, borate, fluoride and borate ester are preferable. Specifically, the B compound is preferred to be boron oxide, boric acid, ammonium borate, lithium borate, sodium borate, potassium borate, zinc borate, boron fluoride, trimethyl borate, triethyl borate, tripropyl borate, tributyl borate, triisopropyl borate, tris(trimethylsilyl) borate, and tris(2,2,2-trifluoroethyl) borate. Among these compounds, one kind can be used alone, or two or more kinds can be used in combination.

The oxide portions 2 further contain P and at least one element selected from the group consisting of Na, Zn, Ba, Si and Zr. The compounds containing these elements are not particularly limited, and the elements mentioned above are preferably contained as phosphate compound, oxide and hydroxide. With the addition of these materials, the formed oxide portions will have a higher electrical resistivity. Also, more complex composite oxides are formed, so the adhesion to the soft magnetic metal particles becomes stronger.

The material for forming the oxide portions 2 can be specifically listed as disodium hydrogen phosphite (5-hydrate), boron phosphate, sodium dihydrogen phosphate, sodium dihydrogen phosphate (2-hydrate), disodium hydrogen phosphate, disodium hydrogen phosphate (5-hydrate), disodium hydrogen phosphate (12-hydrate), trisodium phosphate, trisodium phosphate (6-hydrate), trisodium phosphate (12-hydrate), zinc dihydrogen phosphate, zinc phosphate, zinc phosphate (4-hydrate), barium hydrogen phosphate, zirconium phosphate, tetrasodium pyrophosphate, tetrasodium pyrophosphate (10-hydrate), disodium dihydrogen pyrophosphate, zinc pyrophosphate (3-hydrate), barium pyrophosphate, sodium oxide, zirconium pyrophosphate, zinc oxide, barium oxide, sodium hydroxide, zinc hydroxide, barium hydroxide, barium hydroxide (8-hydrate), sodium zincate, sodium metaborate (4-hydrate), zinc borate (3.5-hydrate), sodium tetraborate (10-hydrate), tetraethyl silicate, trimethoxymethylsilane, hexyltrimethoxysilane, N-2-(aminoethyl)-3-aminopropyltrimethoxysilane, triethoxymethylsilane, hexyltriethoxysilane, octamethyltrisiloxane, hexamethyldisiloxane, tetraisopropyl zirconium and the like. However, the material is not limited thereto. Among these materials, one kind can be used alone, or two or more kinds can be used in combination.

The total amount of B and V contained in the oxide portions 2 inside the soft magnetic powder core is 0.1 mass % or more and 1.0 mass % or less. The amount of B and the amount of V contained in the oxide portions 2 of the powder magnetic core are preferably obtained by subtracting the amount of B and the amount of V contained in the whole starting powder measured by a ICP-AES measurement apparatus from the amount of B and the amount of V contained in the whole powder magnetic core measured by the same method. The method for measuring the amount of B and the amount of V contained in the oxide portions 2 of the soft magnetic powder core is not limited thereto if a method with a better accuracy is present. When the total amount of V and B contained in the oxide portions 2 of the soft magnetic powder core is 0.1 mass % or more, the electrical resistivity becomes higher because the oxide portions sufficiently cover the soft magnetic metal particles. When the total amount of B and V is 1.0 mass % or less, the film thickness of the oxide portions will not become thick, so the stress will not be applied to the interior of the coating film. In this way, the mechanical strength becomes higher.

The oxide portions 2 have a multilayered structure with at least three layers in the interior. It is preferable that a phosphate layer, an oxide layer containing V, B and Fe, and another phosphate layer are seen in sequence among the soft magnetic metal particles. In this case, the soft magnetic metal particles are uniformly covered by the phosphate coating film and the oxide coating film containing V, B and Fe, so the electrical resistivity becomes higher.

Figure 2:
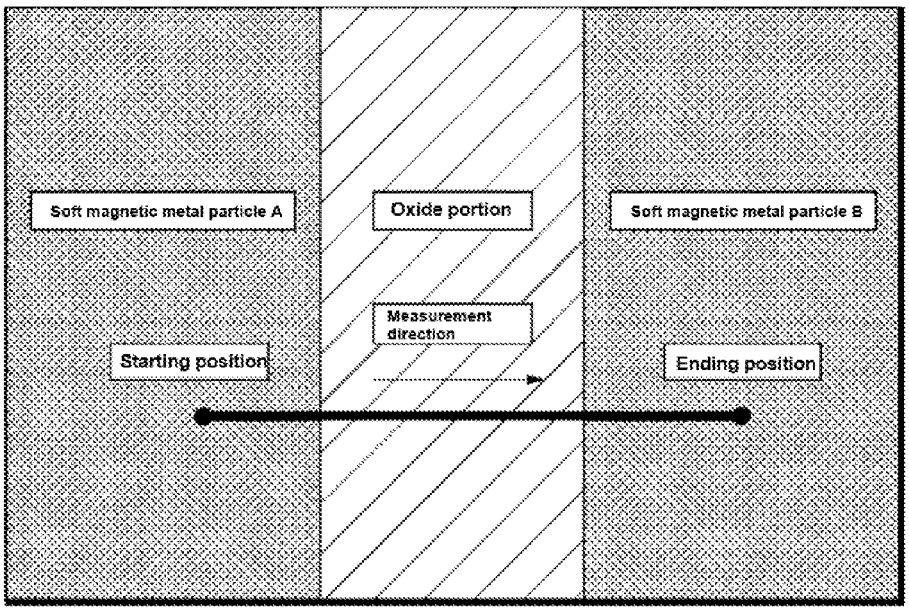
FIG. 2 is a schematic view showing the measurement points in the STEM test.

The oxide portions 2 are analyzed by the line analysis of STEM-EDS. The measurement via STEM is performed by observing the gap between two soft magnetic metal particles with an oxide portion 2 interposed as shown in FIG. 2. The number of layers inside the oxide portion 2 is determined in accordance with the main component of each contained element except Fe, O, B and the light elements lighter than B. If the deviation of the data from the line analysis of each element is large, a smoothing treatment is preferably done by averagely moving the curves in two intervals.

Furthermore, the film thickness of each layer inside the oxide portion 2 is preferably 10 nm or more and 200 nm or less, and more preferably 4 nm or more and 30 nm or less. When the film thickness of each layer is 10 nm or more, the insultivity among particles can be maintained and thus the electrical resistivity becomes higher. If the film thickness of each layer is 200 nm or less, the stress will hardly be applied to the interior of the oxide layer, and thus the mechanical strength becomes higher.

It is preferable that the powder magnetic core further contain glass portions 3 in the interior. The glass portions 3 are preferably formed by softening a glass material with a low melting point via heat under pressure. The glass material with a low melting point has a low melting point, and a diffusion reaction occurs between the glass material and the soft magnetic metal particles via heating so that the glass portions 3 are formed accordingly. In addition, since the glass portions can fill the large voids which cannot be filled by the oxide portions 2, the mechanical strength further increases.

The presence of the glass portions 3 can be determined according to the composition and the presence of crystallinity. For example, such a determination can be done through the COMPO image observed via SEM, the EDS analysis and EPMA analysis, the electron diffraction pattern analyzed by TEM, or observation of high-resolution image analyzed via (S)TEM. The glass material with a low melting point which forms the glass portions 3 is preferably, for example. $Bi_2O_3$—$B_2O_3$ based glass, $Bi_2O_3$—ZnO—$B_2O_3$ based glass, $V_2O_5$—$P_2O_5$ based glass. $V_2O_5$—$B_2O_3$ based glass or the like. Among these glass materials with a low melting point, one kind can be used alone, or two or more kinds can be used in combination. The transition point or the softening point of the glass material with a low melting point is lower than the annealing temperature, so a diffusion reaction occurs between the glass material with a low melting point and the soft magnetic metal particles through heat. In this respect, the amorphous glass portions 3 are formed so that the mechanical strength will further increase.

EXAMPLES

Hereinafter, the present invention will be described in detail based on the Examples. However, the present invention is not limited to these Examples.

Production Method

Example 1

The pure iron (manufactured by Höganäs AB Corporation, trade name: ABC100.30, with an average particle size of 100 μm) was prepared as the soft magnetic metal particles with Fe as the main component (the stating powder). Then, 0.30 mass % of vanadium isopropoxide and 0.96 mass % of triethyl borate were dissolved in isopropyl alcohol (IPA) to prepare a solution for insulating film coating treatment. The starting powder and the solution for insulating film coating treatment were mixed and left to be dried so as to produce a soft magnetic material.

Thereafter, the soft magnetic material used as the sample for measurement of electrical resistivity and also as the sample for the three point bending strength test was molded at 130° C. under a pressure of 981 MPa to be a bar-like sample with a length of 30 mm, a width of 10 mm and a thickness of 5.5 mm. Then, a thermal treatment was performed in air atmosphere at 500° C. for 1 hour, and thus a soft magnetic powder core was obtained.

Comparative Example 1

The pure iron was prepared as the starting powder. The starting powder was molded at 130° C. under a pressure of 981 MPa to be a bar-like sample with a length of 30 mm, a width of 10 mm and a thickness of 5.5 mm. Then, a thermal treatment was performed in air atmosphere at 500° C. for 1 hour, and thus a soft magnetic powder core was obtained.

Comparative Example 2

The pure iron was prepared as the starting powder. Then, 0.30 mass % of vanadium isopropoxide was dissolved in isopropyl alcohol (IPA) to prepare a solution for insulating film coating treatment. The starting powder and the solution for insulating film coating treatment were mixed and left to be dried so as to produce a soft magnetic material.

Thereafter, the same processes were performed as in Example 1 so as to obtain a soft magnetic powder core.

Comparative Example 3

The pure iron was prepared as the starting powder. Then, 0.96 mass % of triethyl borate was dissolved in isopropyl alcohol (IPA) to prepare a solution for insulating film coating treatment. Then, the starting powder and the solution for insulating film coating treatment were mixed and left to be dried so as to produce a soft magnetic material.

Thereafter, the same processes were performed as in Example 1 so as to obtain a soft magnetic powder core.

Example 2, Example 3, Comparative Example 4 and Comparative Example 5

The pure iron was prepared as the starting powder. Then, the starting powder and a solution for insulating film coating treatment were mixed, wherein the solution contained V and B with the amounts shown in Table 1. The mixture was left to be dried so as to produce soft magnetic materials.

Thereafter, the same processes were performed to each soft magnetic material as in Example 1 so as to obtain the corresponding soft magnetic powder core.

<Method for Evaluation>

In the three point bending strength test, the strength of JISZ2511 was measured by a universal strength testing machine (an autograph, AG-5000I/R, manufactured by SHIMADZU Corporation). In the measurement of the electrical resistivity, side surfaces of two ends (square of 10×5.5) of the sample for measurement of electrical resistivity were polished and then coated with the In—Ga paste to form the terminal electrodes. Then, a low resistance meter (MODEL3569, manufactured by Tsuruga Electric Corporation) was used to measure the electrical resistance between two terminals.

The structure and composition of the soft magnetic powder core obtained in Examples 1 to 3 and Comparative Examples 1 to 5 were confirmed by the observation via STEM. In the observation via STEM, the bar-like sample was cut with a section of 10 mm×5.5 mm and then mirror polished. Then, the sample for observation was prepared by a micro-sampling which used the Dual-BeamFIB (Nova200). After the sample was prepared, the element mapping and the point analysis were done by an EDS (Energy Dispersive X-ray Spectrometer) by using a transmission electron microscope (JEM-2100F) at an acceleration voltage of 200 kV.

The amount of V and the amount of B in the starting powder and the soft magnetic powder core obtained in Examples 1 to 3 and Comparative Examples 1 to 5 were measured by an ICP-AES. Three sample sheets with a length of about 5 mm, a width of about 10 mm and a thickness of about 5.5 mm were cut from the bar-like sample mentioned above. Each sample was crushed to powders by using a mortar and then weighed. The powders were dissolved with heat in aqua regia, and then put into a measuring flask of 50 ml and aqua regia was added until the total volume reached 50 ml. Then, the measurement was carried out by an inductively coupled plasma atomic emission spectrometer (the ICP-AES device: ICPS-8100CL manufactured by SHIMADZU Corporation), and the average was calculated from 3 points. Subsequently, the amount of V and the amount of B in the oxide portions were respectively obtained by subtracting the amount of V and the amount of B in the starting powder from the amount of V and the amount of B in the soft magnetic powder core.

The analysis results in Examples 1 to 3 and Comparative Examples 1 to 5 were shown in Table 1.

TABLE 1

| | V | B | Fe | Amount of B (mass %) | Amount of V (mass %) | Amount of B/ amount of V |
|---|---|---|---|---|---|---|
| Example 1 | Yes | Yes | Yes | 0.060 | 0.039 | 1.5 |
| Example 2 | Yes | Yes | Yes | 0.065 | 0.121 | 0.5 |
| Example 3 | Yes | Yes | Yes | 0.099 | 0.020 | 5.0 |
| Comparative Example 1 | No | No | Yes | — | — | — |
| Comparative Example 2 | Yes | No | Yes | — | 0.100 | — |
| Comparative Example 3 | No | Yes | Yes | 0.100 | — | — |
| Comparative Example 4 | Yes | Yes | Yes | 0.035 | 0.092 | 0.4 |
| Comparative Example 5 | Yes | Yes | Yes | 0.118 | 0.020 | 6.0 |

As shown in Table 1, in Examples 1 to 3, Comparative Example 4 and Comparative Example 5, V, B and Fe were detected in the oxide portions according to the results of the STEM observation. Only Fe was detected in the oxide portions according to Comparative Example 1, Fe and V were detected according to Comparative Example 2, and Fe and B were detected according to Comparative Example 3. It could be known from the results of analysis via ICP-AES that the mass ratios of the amount of B to the amount of V (amount of B amount of V) in Examples 1 to 3 were all 0.5 or more and 5.0 or less. In addition, it could be seen that the mass ratios of the amount of B to the amount of V (amount of B/amount of V) in Comparative Example 4 and Comparative Example 5 were respectively lower than 0.5 and larger than 5.0.

The measurement results in Examples 1 to 3 and Comparative Examples 1 to 5 were shown in Table 2.

TABLE 2

| | Strength (MPa) | Electrical resistivity (μΩ · m) | Density (g/cm$^3$) |
|---|---|---|---|
| Example 1 | 204 | 2520 | 7.66 |
| Example 2 | 190 | 2284 | 7.60 |
| Example 3 | 192 | 3731 | 7.62 |
| Comparative Example 1 | 215 | 10 | 7.73 |
| Comparative Example 2 | 140 | 662 | 7.69 |
| Comparative Example 3 | 164 | 1935 | 7.66 |
| Comparative Example 4 | 166 | 1040 | 7.65 |
| Comparative Example 5 | 155 | 3732 | 7.53 |

As shown in Table 1 and Table 2, it could be confirmed that the electrical resistivity was 2000 μΩ·m or more and the three point bending strength was 190 MPa or more in Examples 1 to 3 in which the oxide portions contained all of V, B and Fe, suggesting that the electrical resistivity and the strength were both high. On the other hand, in Comparative Examples 1 to 3 in which the oxide portions did not contain all of V, B and Fe, consideration to both the strength and the electrical resistivity was not given. In addition, in Examples 1 to 3 in which the amount of B is 0.5 or more times and 5.0 or less times of the amount of V in terms of mass ratio, the electrical resistivity was 2000μΩ·m or more and the three point bending strength was 190 MPa or more, suggesting that the electrical resistivity and the strength were both high. However, in Comparative Example 4 and Comparative Example 5 in which the mass ratio of the amount of B to the amount of V was lower than 0.5 or larger than 5.0, the strength and the electrical resistivity were not taken into account at the same time.

Examples 4 to 13

The pure iron was prepared as the starting powder. Then, a solution for insulating film coating treatment was prepared by dissolving 0.2 mass % of phosphoric acid and 0.004 mass % of a material listed in Table 3 relative to the starting powder into IPA. Subsequently, the starting powder and the solution for insulating film coating treatment were mixed and left to be dried so as to produce the soft magnetic materials.

Thereafter, the same solution for insulating film coating treatment as in Example 1 was prepared. Then, each soft magnetic material was mixed with the solution for insulating film coating treatment and the mixture was left to be dried. In this way, each of the soft magnetic materials was prepared.

Then, the same processes were performed to each soft magnetic material as in Example 1 so as to prepare each soft magnetic powder core.

The materials in Examples 4 to 13 were shown in Table 3, and the results of measurement were shown in Table 4.

TABLE 3

| | Material | Mixing ratio of materials | Additive element |
|---|---|---|---|
| Example 4 | zinc phosphate (4-hydrate) | — | P, Zn |
| Example 5 | sodium dihydrogen phosphate | — | P, Na |
| Example 6 | barium hydrogen phosphate | — | P, Ba |
| Example 7 | tetraethyl silicate | — | P, Si |
| Example 8 | tetraisopropyl zirconium | — | P, Zr |
| Example 9 | zinc phosphate (4-hydrate) barium hydrogen phosphate | 1:1 | P, Zn, Ba |
| Example 10 | zinc phosphate (4-hydrate) sodium dihydrogen phosphate | 1:1 | P, Zn, Na |
| Example 11 | barium hydrogen phosphate sodium dihydrogen phosphate | 1:1 | P, Ba, Na |
| Example 12 | zinc phosphate (4-hydrate) tetraethyl silicate | 1:1 | P, Zn, Si |
| Example 13 | zinc phosphate (4-hydrate) tetraisopropyl zirconium | 1:1 | P, Zn, Zr |

TABLE 4

| | Element contained in oxide portion | Strength (MPa) | Electrical resistivity (μΩ · m) |
|---|---|---|---|
| Example 4 | V, B, Fe, P, Zn | 212 | 11823 |
| Example 5 | V, B, Fe, P, Na | 190 | 14239 |
| Example 6 | V, B, Fe, P, Ba | 190 | 13760 |
| Example 7 | V, B, Fe, P, Si | 201 | 8024 |
| Example 8 | V, B, Fe, P, Zr | 195 | 20023 |
| Example 9 | V, B, Fe, P, Zn, Ba | 222 | 10791 |
| Example 10 | V, B, Fe, P, Zn, Na | 198 | 17992 |
| Example 11 | V, B, Fe, P, Ba, Na | 193 | 16123 |
| Example 12 | V, B, Fe, P, Zn, Si | 203 | 9173 |
| Example 13 | V, B, Fe, P, Zn, Zr | 198 | 24098 |

As shown in Table 4, it could be seen that in Examples 4 to 13 in which the oxide portions were formed to contain P and at least one selected from the group consisting of Na, Zn, Ba, Si and Zr besides MV, B and Fe, the electrical resistivity was 2000μΩ·m or more and the three point bending strength was 190 MPa or more, suggesting that both the electrical resistivity and the strength were high.

Example 14 and Example 15

The pure iron was prepared as the starting powder. Then, a solution for insulating film coating treatment was prepared by dissolving 0.2 mass % of phosphoric acid and 0.004 mass % of zinc phosphate (4-hydrate) relative to the starting powder into IPA. The starting powder and the solution for insulating film coating treatment were mixed and left to be dried so as to produce each of the soft magnetic materials.

Further, the soft magnetic material was mixed with the solution for insulating film coating treatment which contained V and B in amounts listed in Table 5. The mixture was left to be dried so as to prepare each soft magnetic material.

Then, the same processes were performed to each soft magnetic material as in Example 1 so as to prepare each soft magnetic powder core.

The amount of V and the amount of B in the soft magnetic powder core obtained in Examples 14 and Example 15 were measured by the inductively coupled plasma atomic emission spectrometer (the ICP-AES device). Three sample sheets with a length of about 5 mm, a width of about 10 mm and a thickness of about 5.5 mm were cut from the bar-like sample mentioned above. Each sample was crushed to powders by using a mortar and then weighed. The powders were dissolved with heat in aqua regia and put into a measuring flask of 50 ml, and aqua regia was added until the total volume reached 50 ml. Then, the ICP-AES device (ICPS-8100CL manufactured by SHIMADZU Corporation) was used in the measurement, and the average was calculated from 3 points. Subsequently, the amount of V and the amount of B in the oxide portions were obtained by subtracting the amount of V and the amount of B in the starting powder from the amount of V and the amount of B in the soft magnetic powder core.

The results of analysis and measurement in Example 14 and Example 15 were shown in Table 5.

TABLE 5

| | Amount of B + amount of V (mass %) | Strength (MPa) | Electrical resistivity (μΩ · m) |
|---|---|---|---|
| Example 14 | 0.1 | 190 | 5200 |
| Example 15 | 1.0 | 191 | 225200 |

As shown in Table 5, it could be seen that when the total amount of V and B fell within the range of 0.1 mass % or more and 1.0 mass % or less, the electrical resistivity was 2000 μΩ·m or more and the strength was 190 MPa or more, suggesting that both the electrical resistivity and the strength were high.

Comparative Example 6

The pure iron was prepared as the starting powder. Then, a solution for insulating film coating treatment was prepared by dissolving 0.2 mass % of phosphoric acid relative to the starting powder in IPA. The starting powder and the solution for insulating film coating treatment were mixed and left to be dried so as to produce a soft magnetic material.

Then, the same processes were performed as in Example 1 so as to prepare a soft magnetic powder core.

The particle interface in the soft magnetic powder core obtained in Example 4 and Comparative Example 6 was determined by an observation via STEM. In the observation via STEM, the bar-like sample was cut with a section of 10 mm×5.5 mm and then mirror polished. Then, the sample for observation was prepared by a micro-sampling which used the Dual-BeamFIB (Nova200). After the sample was prepared, the composition analysis was done by an EDS (Energy Dispersive X-ray Spectrometer) by using a transmission electron microscope (JEM-2100F) at an acceleration voltage of 200 kV The oxide portions among soft magnetic metal particles were subjected to a point analysis and a line analysis at about 200 points with equal distance between each two on the conditions that the beam diameter was 1 nm and the aperture diameter of the condenser was 40 μm. The schematic diagram of the site to observe was shown in FIG. 2.

Figure 3:
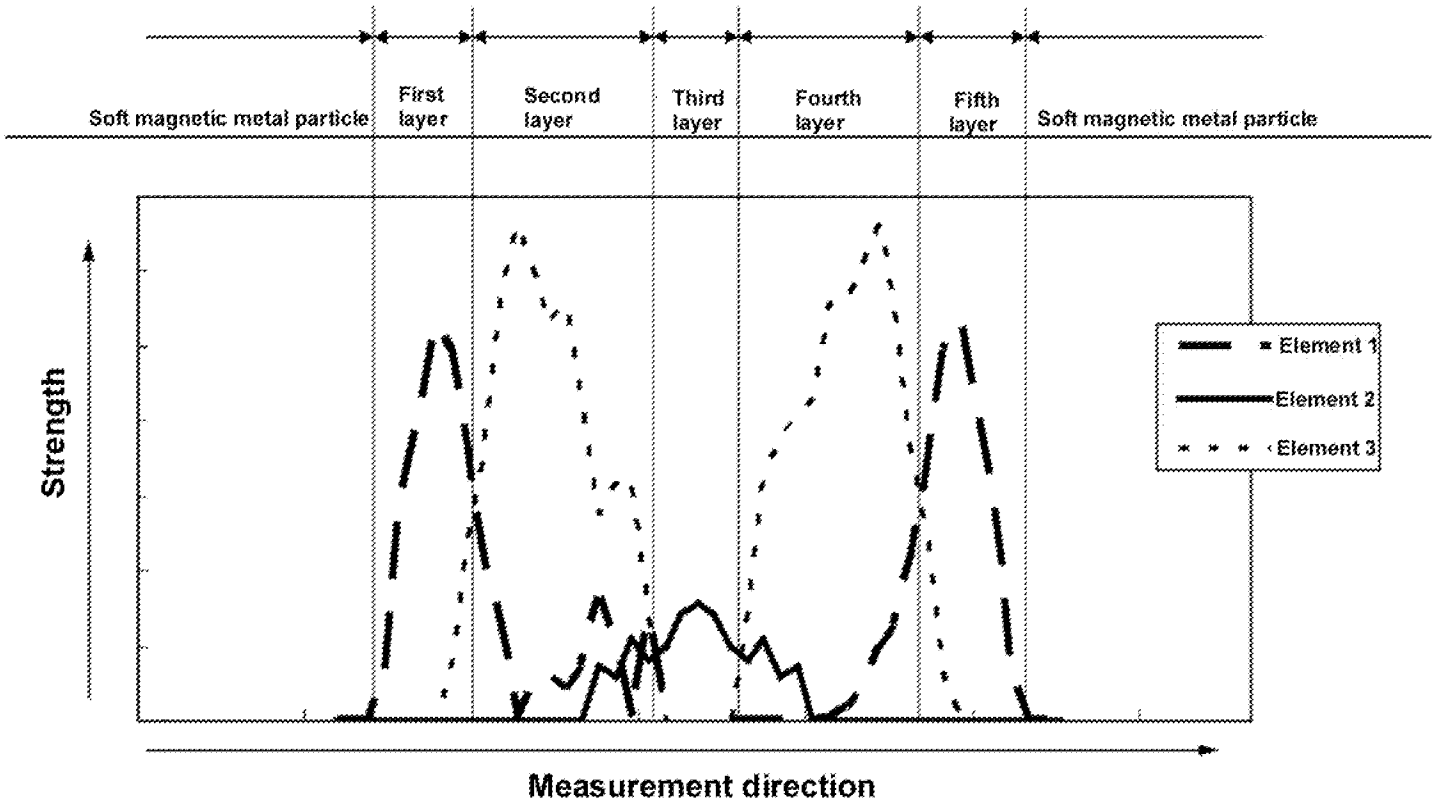
FIG. 3 is a schematic view showing the separated layers based on each kind of element in the main component in the results of the STEM measurement.

With respect to the determination results of the line analysis of each element via STEM-EDS, the data was made for the composition ratio of the elements except Fe, O, B, and light element lighter than B which were contained in the oxide portion, and layers were separated based on each kind of element in the main component. FIG. 3 showed the schematic diagram of the analysis results.

The analysis results for the number of layers and the determination results of the properties in Example 4 and Comparative Example 6 were shown in Table 6.

TABLE 6

| | Number of layers | Strength (MPa) | Electrical resistivity (μΩ · m) |
|---|---|---|---|
| Example 4 | 3 | 221 | 11823 |
| Comparative Example 6 | 1 | 170 | 319 |

It could be seen from Table 6 that when the oxide layer inside the soft magnetic powder core contained a multilayered structure with three layers or more, the electrical resistivity was 2000μΩ·m or more and the strength was 190 MPa or more, suggesting that both the electrical resistivity and the strength were high.

Example 16

The same soft magnetic material as in Example 1 was prepared as the starting powder.

Then, the Bi based glass material with an average particle size of 3 μm which was used as the glass material with a low melting point was added to the soft magnetic material in the amount of 0.3 mass % relative to the soft magnetic material. The mixture was added to a mixer (trade name: V Mixer, manufactured by Tsutsui Scientific Instruments Co., Ltd.) and then mixed at a rotating speed of 12 rpm for 10 minutes. Next, the mixed mixture was molded at 130° C. under a pressure of 981 MPa into a bar-like sample with a length of 30 mm, a width of 10 mm and a thickness of 5.5 mm. Thereafter, a thermal treatment was performed at 500° C. under air atmosphere so as to obtain a soft magnetic powder core.

Example 17

The same soft magnetic material as in Example 4 was prepared as the starting powder.

Then, the Bi based glass material which was used as the glass material with a low melting point was added to the soft magnetic material in an amount of 0.3 mass % relative to the soft magnetic material. The mixture was added to a mixer (trade name: V Mixer, manufactured by Tsutsui Scientific Instruments Co., Ltd.) and then mixed at a rotating speed of 12 rpm for 10 minutes. Then, the mixed mixture was molded at 130° C. under a pressure of 981 MPa into a bar-like sample with a length of 30 mm, a width of 10 mm and a thickness of 5.5 mm. Thereafter, a thermal treatment was performed at 500° C. under air atmosphere so as to obtain a soft magnetic powder core.

Example 18

A soft magnetic powder core was prepared by using the same method as in Example 17 except that the glass with a low melting point was replaced with a V based glass material.

Figure 4:
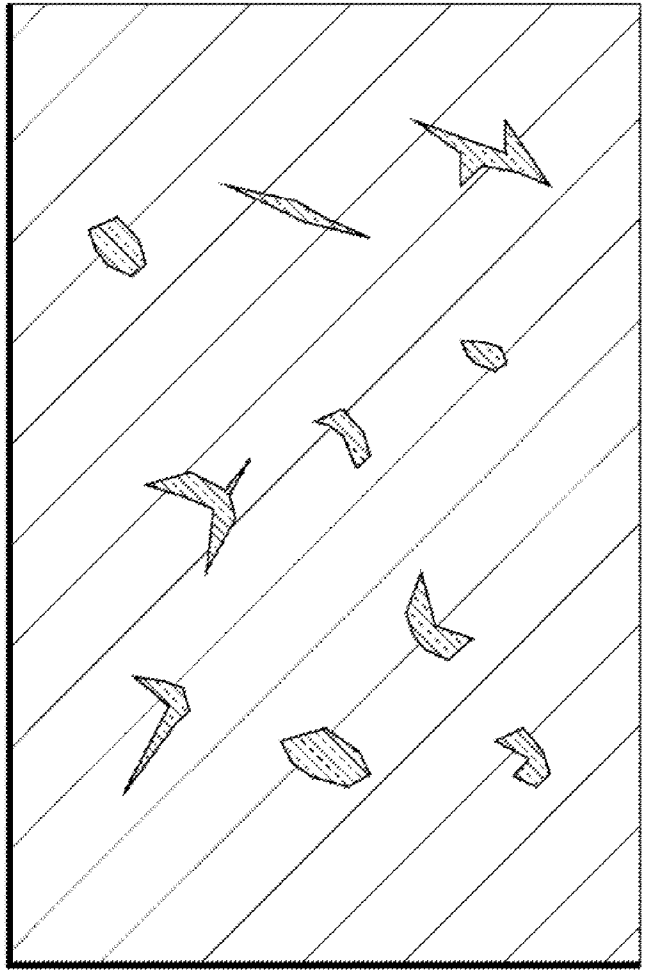
FIG. 4 is a schematic view showing the analysis result obtained from the COMPO image observed by SEM.

The structure and composition of the soft magnetic powder core obtained in Examples 16 to 18 were determined through the COMPO images from the observation via SEM-EDS or observation via SEM. In the observation via SEM-EDS, the bar-like sample was cut with a section of 10 mm×5.5 mm and then mirror polished. Then, the sample for observation was prepared by a surface treatment using a flat milling machine (IM-3000 manufactured by Hitachi High-Technologies Corporation). After the sample was prepared, the particle interface was subjected to the SEM-EDS analysis. FIG. 4 showed the schematic COMPO image of the cross-section in the powder magnetic core observed via SEM. It could be seen in each sample for observation that the glass portions were scattered in the cross-section of the powder magnetic core.

The analysis results and the measurement results in Examples 16 to 18 were shown in Table 7.

TABLE 7

| | Presence of glass portions | Strength (MPa) | Electrical resistivity (μΩ · m) | Additive element |
|---|---|---|---|---|
| Example 16 | Yes | 195 | 94900 | — |
| Example 17 | Yes | 225 | 252020 | P, Zn |
| Example 18 | Yes | 205 | 152110 | P, Zn |

As shown in Table 7, it could be known that when the glass portions were present in the soft magnetic powder core, the electrical resistivity was 2000μΩ·m or more and the strength was 190 MPa or more, suggesting that both the electrical resistivity and the strength were further improved.

As described above, the soft magnetic powder core according to the present invention can be widely and effectively used in the motor, the actuator, the generator, the reactor and the choke coil as well as various machines, devices, systems or the like having these components because it has a high electrical resistivity and a high strength.

DESCRIPTION OF REFERENCE NUMERALS

1 soft magnetic metal particle
2 oxide portion
3 glass portion

What is claimed is:

1. A soft magnetic powder core comprising soft magnetic metal particles with Fe as the main component, wherein, said powder core comprises oxide portions containing V, B and Fe among said soft magnetic metal particles, the amount of B is 0.5 or more times and 5.0 or less times of the amount of V in terms of mass ratio, and the total amount of V and B contained in said oxide portions of said powder core is 0.1 mass % or more and 1.0 mass % or less, based on the mass of the oxide portions.

2. The soft magnetic powder core according to claim 1, wherein, said oxide portions further comprise P and at least one element selected from the group consisting of Na, Zn, Ba, Si and Zr.

3. The soft magnetic powder core according to claim 2, wherein, said oxide portions have a multilayered structure with three layers or more in the interior.

4. The soft magnetic powder core according to claim 3, wherein, said soft magnetic powder core comprises glass portions inside the magnetic core.

5. The soft magnetic powder core according to claim 2, wherein, said soft magnetic powder core comprises glass portions inside the magnetic core.

6. The soft magnetic powder core according to claim 1, wherein, said oxide portions have a multilayered structure with three layers or more in the interior of said soft magnetic powder core.

7. The soft magnetic powder core according to claim 6, wherein, said soft magnetic powder core comprises glass portions inside the magnetic core.

8. The soft magnetic powder core according to claim 1, wherein, said soft magnetic powder core comprises glass portions inside the magnetic core.

9. The soft magnetic powder core according to claim 1, wherein said powder core has a minimum bending strength of 190 MPa and a minimum electric resistivity of 2000 μΩ·m.

10. The soft magnetic powder core according to claim 1, wherein the amount of B is 1.5 or more times and 5.0 or less times of the amount of V in terms of mass ratio.

* * * * *